United States Patent [19]

Castellanos

[11] 4,353,379

[45] Oct. 12, 1982

[54] PORTABLE PERSONAL ASH RECEIVER

[76] Inventor: Rafael Castellanos, 117 E. 11th St., Hialeah, Fla. 33010

[21] Appl. No.: 241,432

[22] Filed: Mar. 6, 1981

[51] Int. Cl.[3] ..... A24F 19/00; B65D 73/00

[52] U.S. Cl. ..... 131/231; 220/8; 206/496

[58] Field of Search ..... 131/235 R, 231, 175, 131/242; 206/38, 246, 529, 496; 220/8

[56] References Cited

U.S. PATENT DOCUMENTS

| | | | |
|---|---|---|---|
| 1,334,716 | 6/1920 | Powell | 220/8 |
| 2,256,257 | 9/1941 | Dukehart, Jr. | 206/537 |
| 2,755,919 | 7/1956 | Genshaw et al. | 206/496 |
| 3,047,134 | 7/1962 | Peck | 206/496 |
| 3,762,539 | 10/1973 | Kerr | 220/8 X |

*Primary Examiner*—Stephen C. Pellegrino

*Attorney, Agent, or Firm*—Ernest H. Schmidt

[57] ABSTRACT

A tubular body member has telescopingly received therein a tubular ash receiver member, closed at its outer end and having a through access opening in the side-wall thereof which is normally covered by an arcuate, extended-wall portion of the body member. A helical tension spring acting between the outer end of the body member and the inner end of the ash receiver member serves to yieldingly constrain the ash receiver member in fully closed position with respect to the tubular base member whereat the access opening is covered by the body member extended-wall portion. In use, the ash receiver member is pulled outwardly of the base member to uncover the access opening, abutment stop means being provided to temporarily maintain the ash receiver in this open position against the urging of the tension spring.

2 Claims, 6 Drawing Figures

PORTABLE PERSONAL ASH RECEIVER

BRIEF DESCRIPTION OF THE INVENTION

This invention relates to cigarette ashtrays and is directed particularly to a novel and improved portable personal ashtray of the type that can be closed after use for carrying in one's pocket or purse.

Various kinds of portable ashtrays have been devised to accommodate cigarette smokers who may wish to smoke from time to time in places where ordinary ashtrays or other means of ash disposal are not available. Most such portable personal ash receivers comprise little more than lidded containers, which are opened for the disposal of cigarette ashes and butts and when closed, permit carrying in one's pocket or purse until they can be suitably emptied. U.S. Pat. Nos. 2,706,484, 2,755,919, 2,776,665, 2,781,761, and 2,996,068 illustrate and describe various such personal ash receivers as have heretofore been devised, all of which are considered to be deficient in one or more respects, principally in that they are bulky, and therefore cannot be conveniently carried on one's person.

It is, accordingly, the principal object of my invention to provide a portable personal ash receiver of the character described that can be conveniently clipped for carrying in a shirt or suit coat pocket as one would a fountain pen.

A more particular object is to provide a portable pocket ash receiver which is tubular in shape and comprised of a pair of telescopingly interfitted parts yieldingly constrined in collapsed, interfitting relation for closure, whereat an access opening in the inner one of the parts is covered by a side-wall portion of the other part, and whereby, upon manual withdrawal of the inner part from the outer part, the access opening is temporarily exposed for the reception of cigarette ashes and butts.

Another object of the invention is to provide a portable personal ash receiver of the character described which will be compact and simple in structure, economical to manufacture, and which will be dependable and durable in use and attractive in appearance.

Other objects, features and advantages of the invention will be apparent from the following description when read with reference to the accompanying drawings.

BRIEF DESCRIPTION OF THE DRAWINGS

In the drawings, wherein like reference numerals denote corresponding parts throughout the several views.

Figure 1:
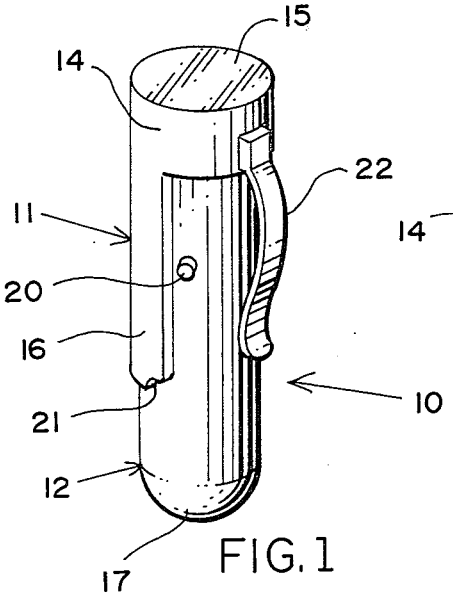
FIG. 1 is an oblique, elevational view of a portable personal ash receiver embodying the invention.

Referring now in detail to the drawings, reference numeral 10 designates, generally, a preferred form of portable personal ash receiver embodying my invention, the same comprising a body member 11, a tubular receptacle member 12, and a helical tension spring 13 interconnecting said body member and said tubular receptacle member in the manner and for the purpose hereinafter more particularly described.

The body member 11, which will preferably be fabricated of metal, is integrally formed with a tubular base portion 14 enclosed by a bottom wall portion 15 at one end, and has an arcuate side-wall portion 16 merging with and extending outwardly of the opposite end. The width of arcuate side-wall portion 16 is such that it extends approximately 120 circular degrees about tubular base portion 14.

The tubular receptacle member 12 is formed with a hemispherical outer end closure wall portion or dome 17, and is of such outer diameter along its length as to be slidingly received, in telescoping fashion, within the tubular base portion of body member 11. A transverse bottom plate 18 is secured in spaced relation with respect to the inner or open end of the tubular receptacle member 12. The helical tension spring 13 is centrally arranged within the body member 11 and has one end affixed, as by spot welding, against the inside of bottom wall portion 15. The other end of the spring 13 is affixed, as by spot welding, to the outside of receptacle member bottom plate 18.

Figure 3:
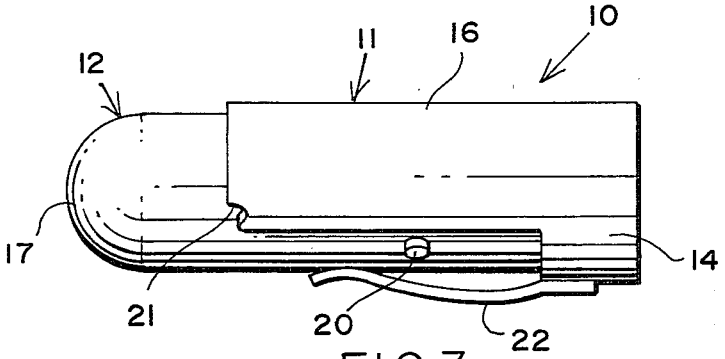
FIG. 3 is a side elevational view thereof, in closed condition as in FIG. 1.
Figure 4:
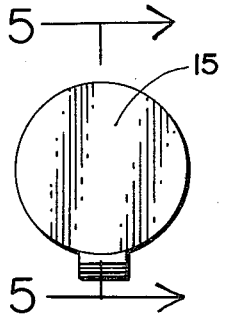
FIG. 4 is a bottom view thereof.
Figure 5:
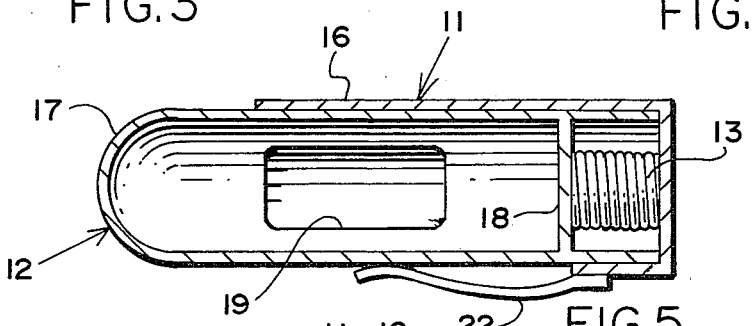
FIG. 5 is a longitudinal cross-sectional view of the ash receiver, in closed condition.

As illustrated in FIGS. 1, 3 and 5, the tension spring 13 serves to yieldingly retain tubular receptacle member 12 in closed or inward-most position with respect to body member 11. As best illustrated in FIG. 5, the tubular receptacle member 12 is provided, centrally along its length, with a rectangular access opening 19, so positioned about its periphery as to be covered by the arcuate side-wall portion 16 of the body member 11 when said tubular receptacle member is in its withdrawn position under the influence of helical tension spring 13.

Figure 2:
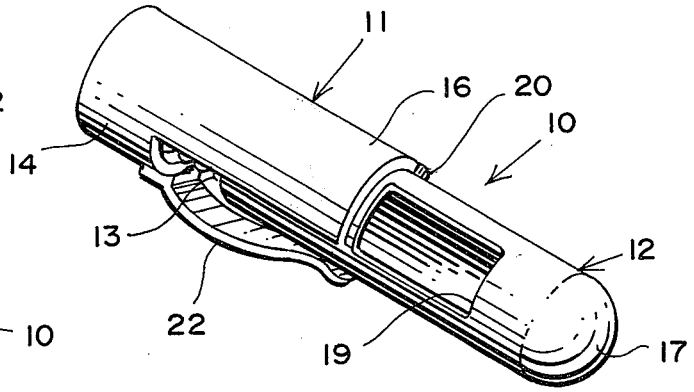
FIG. 2 is a perspective view of the ash receiver illustrated in FIG. 1, shown in its open condition of use.
Figure 6:
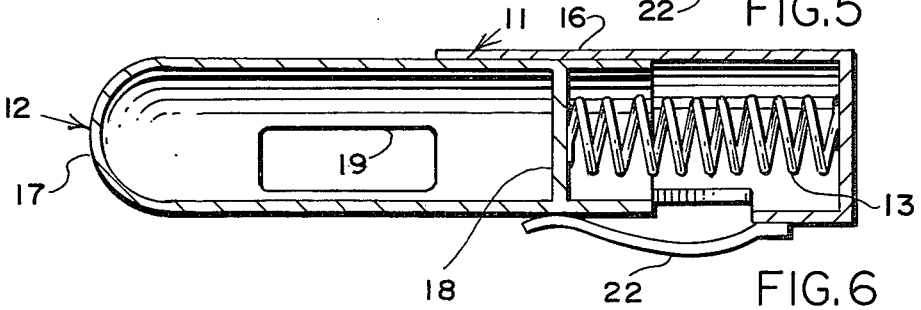
FIG. 6 is a longitudinal cross-sectional view similar to that of FIG. 5, but showing the ash receiver in its open position of use.

Means is provided for releaseably retaining the tubular receptacle member 12 in its withdrawn position of use with respect to body member 11, as illustrated in FIGS. 2 and 6. To this end the tubular receptacle member 12 has affixed thereto and projecting outwardly thereof, a short, cylindrical abutment pin 20 adapted to be received in abutting engagement within an arcuate recess 21 provided at the outer end near the adjacent side of arcuate side-wall portion 16 (see FIGS. 1 and 3).

In use, the tubular receptacle member 12 will be manually withdrawn from the body member 11 of the ash receiver and turned slightly to permit the abutment pin 20 to be temporarily seated within the arcuate recess 21, thereby retaining said receptacle member in relatively open position. In this connection it will be understood that the abutment pin 20 is so inwardly spaced with respect to the arcuate recess 21 that when it is outwardly displaced for reception in said recess, the access opening 19 will have been withdrawn from behind the arcuate side-wall portion 16 of the body member 11. The access opening can then be used for containment of cigarette ashes and a few cigarette butts before emptying. Closure after periods of use while smoking is accomplished simply by pulling the tubular receptacle member 12 outwardly so that its pin 20 clears the arcuate abutment recess 21, then turning the receptacle slightly to clear the adjacent side edge of arcuate side-wall portion 16, whereupon the helical tension spring 13 will automatically withdraw said receptacle member into its closed or covered position as illustrated in FIGS. 1, 3 and 5.

For convenience in carrying the portable personal ash receiver 10, it is provided with a slightly resilient pocket clip 22 affixed at one end to the tubular portion of body member 11 and extending downwardly along the outside of the tubular receptacle member 12. The access opening 19 is large enough to permit emptying when the ash receiver is open simply by shaking out of the contained ashes and cigarette butts.

While I have illustrated and described herein only one form of portable personal ash receiver comprising the invention, it is to be understood that this embodiment is presented by way of example only and not in a limiting sense. The invention, in brief, comprises all the embodiments and modifications coming within the scope and spirit of the following claims.

What I claim as new and desire to secure by Letters Patent is:

1. A portable personal ash receiver, comprising, in combination, a tubular body member closed at one end, a tubular ash receiver member slidingly received within the other end of said tubular body member in telescoping fashion, an enclosure wall at the outer end of said tubular ash receiver member, a through access opening in the peripheral side-wall of said tubular ash receiver member, said tubular body member having an extended peripheral side-wall portion normally in covering relation with respect to said access opening when said tubular ash receiver member is fully received within said tubular body member, and yieldable means constraining said ash receiver member to be fully received in said tubular body member, whereby, upon manual withdrawal of said tubular ash receiver member with respect to said tubular body member against the urging of said yieldable means, said access opening will be exposed for the receiption of cigarette ashes and butts into said tubular ash receiver member, abutment means operative to selectively maintain said tubular ash receiver member in the withdrawn position with respect to said tubular body member, said abutment means comprising an abutment pin extending outwardly of the peripheral side-wall of said tubular body member and operative to be abuttingly retained in a recess in the outer end of said extended peripheral side-wall portion of said tubular body member upon the relative rotation of said body member and ash receiver member when in their relatively withdrawn positions, said yieldable constraining means comprising a tension spring acting between the closed end of said tubular body member and the inner end of said tubular ash receiver member, said tubular ash receiver member being provided with a transverse bottom plate secured in spaced relation with respect to the inner end of said tubular receiver member, one end of said tension spring being secured to said transverse bottom plate and the other end being secured to said closed end of said tubular body member.

2. A portable personal ash receiver as defined in claim 1, including a resilient pocket clip affixed at one end to and extending longitudinally outwardly of said tubular body member in peripherally spaced relation with respect to said extended peripheral side-wall portion.

* * * * *